US009217274B2

(12) United States Patent
Kemp

(10) Patent No.: US 9,217,274 B2
(45) Date of Patent: Dec. 22, 2015

(54) GAS FILLING APPARATUS

(75) Inventor: Malcolm Kemp, Hertfordshire (GB)

(73) Assignee: Inagas, Hertfordshire (GB)

( * ) Notice: Subject to any disclaimer, the term of this patent is extended or adjusted under 35 U.S.C. 154(b) by 265 days.

(21) Appl. No.: 13/820,264

(22) PCT Filed: Aug. 26, 2011

(86) PCT No.: PCT/GB2011/051612
§ 371 (c)(1),
(2), (4) Date: Mar. 1, 2013

(87) PCT Pub. No.: WO2012/028868
PCT Pub. Date: Mar. 8, 2012

(65) Prior Publication Data

US 2013/0160892 A1 Jun. 27, 2013

(30) Foreign Application Priority Data

Sep. 1, 2010 (GB) ..... 1014486.3

(51) Int. Cl.
*E06B 3/677* (2006.01)
*F17C 5/00* (2006.01)

(52) U.S. Cl.
CPC .. *E06B 3/677* (2013.01); *F17C 5/00* (2013.01)

(58) Field of Classification Search
CPC ..... E06B 3/677; F17C 5/00
USPC ..... 141/4, 59, 63, 91, 329; 156/104, 109
See application file for complete search history.

(56) References Cited

U.S. PATENT DOCUMENTS

| | | | | |
|---|---|---|---|---|
| 2,756,467 | A | 7/1956 | Etling | |
| 4,176,793 | A | 12/1979 | Heinrich | |
| 4,450,660 | A * | 5/1984 | Dean et al. | 52/202 |
| 4,850,536 | A | 7/1989 | Teranishi et al. | |
| 4,886,095 | A | 12/1989 | Lisec | |
| 5,110,337 | A * | 5/1992 | Lisec | 65/58 |
| 5,381,962 | A | 1/1995 | Teague | |
| 5,454,893 | A * | 10/1995 | Dietz | 156/104 |
| 5,645,678 | A * | 7/1997 | Lisec | 156/382 |

(Continued)

FOREIGN PATENT DOCUMENTS

| | | |
|---|---|---|
| CA | 2118348 A1 | 4/1996 |
| DE | 3117255 C1 | 1/1983 |

(Continued)

OTHER PUBLICATIONS

Author Unknown, "IGA 200: 1 line Argon Gas Filler," Inagas, Date Unknown, http://inagas.co.uk/upload/fmfFAtl0DSh.pdf, 12 pages.

(Continued)

*Primary Examiner* — Nicolas A Arnett
(74) *Attorney, Agent, or Firm* — Withrow & Terranova, PLLC

(57) ABSTRACT

A gas filling apparatus comprising a lance and control unit remote from the lance is disclosed. The lance has a dispensing nozzle for dispensing gas through an aperture. The lance additionally has a manually operable switch for sending a signal to the control unit to commence dispensing of gas. The provision of the manually operable switch on the lance should result in less errors being made during the filling process, particularly where a plurality of lances are simultaneously operated by a single operator. The lance may additionally comprise a visual indicator indicating the state reached in the dispensing cycle.

14 Claims, 2 Drawing Sheets

(56) References Cited

U.S. PATENT DOCUMENTS

| | | | | |
|---|---|---|---|---|
| 5,676,782 | A * | 10/1997 | Lisec | 156/109 |
| 5,948,195 | A * | 9/1999 | Thomas | 156/109 |
| 6,804,924 | B2 * | 10/2004 | Zurn et al. | 52/514 |
| 6,899,151 | B1 * | 5/2005 | Latka et al. | 141/392 |
| 6,916,392 | B2 * | 7/2005 | Trpkovski et al. | 156/104 |
| 8,821,662 | B2 * | 9/2014 | Mader | 156/99 |
| 8,905,085 | B2 * | 12/2014 | Donohue | 141/8 |
| 2004/0016832 | A1 | 1/2004 | Schroeder et al. | |
| 2004/0124208 | A1 * | 7/2004 | Yakasovic et al. | 222/3 |
| 2004/0182518 | A1 * | 9/2004 | Lisec | 156/382 |
| 2004/0211142 | A1 * | 10/2004 | Zurn et al. | 52/514.5 |
| 2008/0099348 | A1 * | 5/2008 | Naylor | 206/0.6 |
| 2010/0242951 | A1 * | 9/2010 | Soucy | 126/675 |

FOREIGN PATENT DOCUMENTS

| | | | |
|---|---|---|---|
| FR | 2442948 | A1 | 6/1980 |
| JP | 55121860 | A | 9/1980 |
| JP | 2003024833 | A | 1/2003 |

OTHER PUBLICATIONS

Search Report for British patent application GB1014486.3 conducted Dec. 15, 2010, 2 pages.

* cited by examiner

GAS FILLING APPARATUS

PRIORITY APPLICATIONS

The present non-provisional application is a National Phase Application of and claims priority to PCT/GB2011/051612 filed Aug. 26, 2011, which claims priority to Great Britain Patent Application No. 1014486.3, filed Sep. 1, 2010, the disclosures of which are incorporated herein by reference in their entireties.

BACKGROUND

1. Field of the Disclosure

The present invention relates to gas filling apparatus and particularly, but not exclusively, to gas filling apparatus for filling insulated glass units (double glazing units) with an inert gas such as argon.

2. Technical Background

Insulated glass units have traditionally comprised two or more panes of glass, with each pair of panes separated by a peripheral spacer bar. The spacer bar has a moisture absorbing element to absorb any moisture in the air in the unit.

The thermal efficiency of insulated glass units can be further improved by inserting an inert gas, typically argon as it relatively inexpensive, in the unit. In the case of very large scale production runs, this can be achieved by automated assembly of the panes and spacer bars in an inert gas. However, the size and expense of the plant required means that this is only possible for the very largest producers of such units.

As an alternative to assembling the panes and spacer bars in an inert atmosphere, the panes and spacer bars can be assembled in air in the traditional manner, with the spacer bar being provided with one or more apertures through which an inert gas can be subsequently introduced and the air removed. One technique for doing this uses two apertures, one at the top of the unit and one at the bottom of the unit with the inert gas being filled through the bottom and the air expelled through the top (the gas being denser than air). The air being expelled through the top of the unit is monitored and when the percentage of inert gas in the air exceeds a predetermined threshold, the filling process is terminated and the apertures are plugged.

An alternative method utilises a single aperture in the spacing bar at the top of the cavity, through which a nozzle of a lance is inserted. This nozzle can be in the form of a coaxial pipe which can both introduce the gas and remove the air. Again, the concentration of gas in the air leaving the unit can be monitored and filling terminated when the gas content exceeds a predetermined threshold.

One gas filler for filling an insulated glass unit in the manner described above is the IGA 200, manufactured by the present applicant. This controls the gas flow to the lance and monitors the percentage of gas in the air returning from the unit.

Filling may be commenced by operation of a start button on the unit and is terminated by the unit detecting the gas in the return air flow is above a predetermined concentration. Typically, an operator will be filling many units and to assist the operator a foot peddle is available to control the dispensing of the gas.

Insulated glass units, depending on their size and the flow rate of gas, may take a minute or more to fill and therefore a single operator may control two or more lances. Gas filling machines are available which have two or more lances, such as the IGA 60, manufactured by the present applicant. Each lance may be controlled by a separate foot peddle, however it is difficult for a single operator to operate more than two lances, for confusion can occur regarding the stage of operation of a particular lance and this may result in units being incorrectly filled.

SUMMARY OF THE DETAILED DESCRIPTION

According to a first aspect of the present invention, there is provided gas filling apparatus comprising a lance having a dispensing nozzle for dispensing gas through an aperture, a control unit remote from the lance and a gas supply line extending from the control unit to the lance, wherein the lance comprises a manually operable switch for sending a signal to the control unit and the control unit is arranged to dispense gas through the lance in response to a signal received from the switch, wherein the control unit further comprises a vacuum port and a gas sensor for determining the concentration of the dispensed gas type received at the vacuum port, the unit being arranged to terminate the dispensing of gas in response to the gas received at the vacuum port exceeding a predetermined concentration. The provision of such a vacuum port enables air to be drawn out of the glass unit and the concentration of gas in the glass unit monitored, so that the dispensing of gas can then be automatically terminated in response to the gas reaching a predetermined concentration. This minimizes both the time required to fill the unit and the amount of gas required to fill the unit.

The present invention provides a switch on the lance itself and therefore the switch is directly associated with the lance and thus no confusion can occur as to which lance will be operated by actuation of the switch. Preferably, the lance is arranged to be handheld, is connected to the control unit through a flexible supply line, is arranged to be inserted in an aperture in a non-engaging manner. This permits the lance to be relatively small, such that it may be connected to the unit to be filled simply by insertion of the nozzle through the aperture in the unit in a non-engaging manner. In the context of the present specification, "non-engaging manner" is to be interpreted as meaning not sealing with or mechanically interlocking with.

The lance being retained in place, simply by the nozzle being inserted through the aperture, enables the lance to be quickly inserted and removed, both for efficient operation and to ensure the aperture can be quickly plugged after filling has been terminated, to prevent air seeping in and diluting the gas. It is normally possible for air to mix with the gas through the aperture even with the nozzle in place because the aperture is significantly larger than the nozzle to ensure no pressurisation of the glass unit occurs.

It is preferable that the lance is relatively lightweight so that it can be retained in place solely by the nozzle being inserted in the aperture. Also, if the lance should be dislodged or dropped, it will not cause any damage to itself, the operator or any lines connecting it to the control unit. The provision of a switch which sends a signal to the control unit, as opposed to a switch which controls the supply of electricity to components of the unit, means that the switch can be relatively small and the wiring fine, enabling it to be practical to mount the switch on the lance.

Preferably, the control unit incorporates an overfill timer that terminates the dispensing a predetermined period after the gas received at the vacuum port exceeds the predetermined concentration. This feature is desirable, for it permits a small over run which will act to ensure any small space at the top of the unit is filled with gas after the gas has reached the desired concentration at the detection point.

Preferably, the control unit further comprises a dwell time monitor which provides an indication to the operator when a predetermined dwell time, after termination of dispensing, has been exceeded.

As stated above, it is important that the lance is removed shortly after termination of dispensing and the aperture plugged, to ensure the gas does not escape from the unit. The dwell time monitor automatically notifies the operator when this dwell time has been exceeded, which may be particularly advantageous if an operator is using two or more lances simultaneously and is not immediately able to attend to a particular lance on termination of dispensing by that lance. The operator knowing that a dwell time for a particular lance has been exceeded may then simply press the switch to reactivate the lance so that it continues filling, which may only take a few seconds if the unit is still nearly full of gas.

Preferably, the lance incorporates a visual indicator to indicate the status of the control unit. This is particularly advantageous because an operator, operating several lances can determine the status of a lance simply by looking at the lance. For example, the indicator may indicate gas is being dispensed by that lance, or that dispensing has been terminated but a predetermined dwell time after termination of dispensing has not been exceeded, thus the lance can be removed and the aperture plugged. The visual indicator is preferably a light source, such as an LED, which can be one of two colours or OFF and thus can indicate three states; gas being dispensed through the lance; dispensing complete but a predetermined dwell time has not been exceeded for the lance; and dwell time exceeded or dispensing not commenced.

For example if the light source is red when gas is being dispensed, is green when dispensing is complete but a predetermined dwell has not been exceeded and is unlit when the dwell time has been exceeded or dispensing has not been commenced then the operator, especially if using several lances simultaneously, simply ignores any red (filling) lance, activates the switch of any unlit lance, (to commence or recommences filling) and removes any lance with a green light and plugs the aperture. This arrangement enables an operator to operate significantly more lances than would presently be possible.

In one particularly advantageous configuration the lance comprises a solid block of plastics material having machined passageways and threaded connection ports, with a visual indicator embedded in the block, the block being transparent or translucent. This provides a very compact and robust lance which will not be damaged if accidently dropped and may be particularly lightweight. It also ensures the visual indicator can be clearly seen from all directions by the operator.

Preferably, the nozzle comprises a vacuum inlet aperture connected to the vacuum port of the control unit by a vacuum return line. This provides a lance which can both fill the unit and remove the gas for monitoring by the control unit. The vacuum inlet is preferably arranged coaxially with the dispensing nozzle, the nozzle comprising a coaxial pipe that may be easily inserted into a relatively small aperture.

Preferably, the switch is connected by an electrical or optical connection lead extending between the switch and the control unit.

In accordance with a second aspect of the present invention, there is provided a gas filling lance comprising a solid body of translucent or transparent material, a dispensing nozzle, a connection for a gas supply line to the nozzle, a switch for generating a signal and an indicator light embedded in the body.

BRIEF DESCRIPTION OF FIGURES

One embodiment of the present invention will now be described by way of example only, with reference to the accompanying figures, of which.

DETAILED DESCRIPTION

Figure 1:
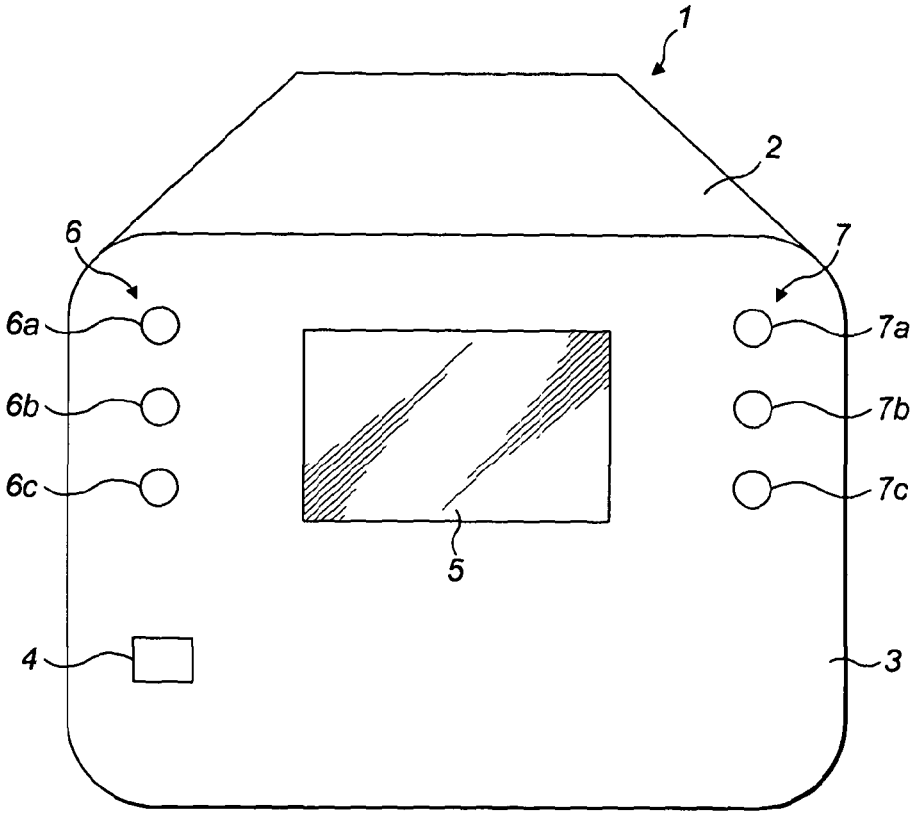
FIG. 1 is a perspective view of a control unit of gas filling apparatus in accordance with the present invention.

Referring to FIG. 1 a control unit, indicated generally as 1, comprises a casing 2 having a front panel 3. The front panel 3 has an ON/OFF switch 4, a touch screen display 5 and two lance connection points 6 and 7. Each lance connection point has a gas supply port 6*a* or 7*a*, vacuum port 6*b* or 7*b* and electrical connector 6*c* or 7*c*. Each pair of ports and electrical connection is associated with a respective lance, as described below with reference to FIG. 3.

Figure 2:
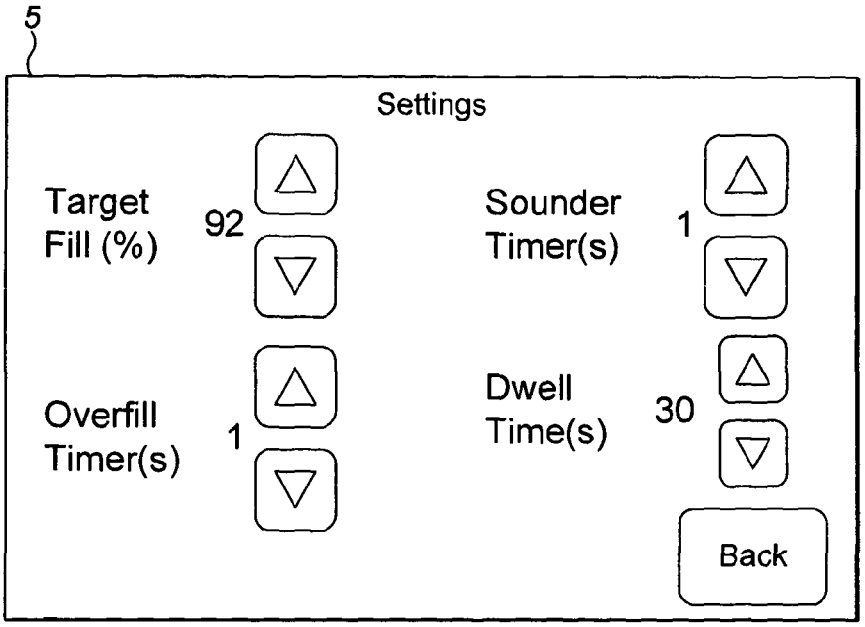
FIG. 2 is an enlarged view of the touch screen display of the control unit of FIG. 1.

Referring now to FIG. 2, the touch screen 5 is illustrated in a 'Settings' mode, where the operator may touch respective up and down arrows appearing on the screen to set the target fill, overfill timer, a sounder timer and dwell time, as described below. These may be set for one lance or for two lances. If two lances are being used, a previous menu screen is selected to determine which lance the settings are for. An alternative screen may be split into two parts, one associated with each lance and each having an ON/OFF button for a respective lance in addition to the switch on the lance.

The particular control unit illustrated may operate one or two lances. However, by adding additional connection points and associated components within the housing, the control unit could be expanded to operate any number of desired lances.

Figure 3:
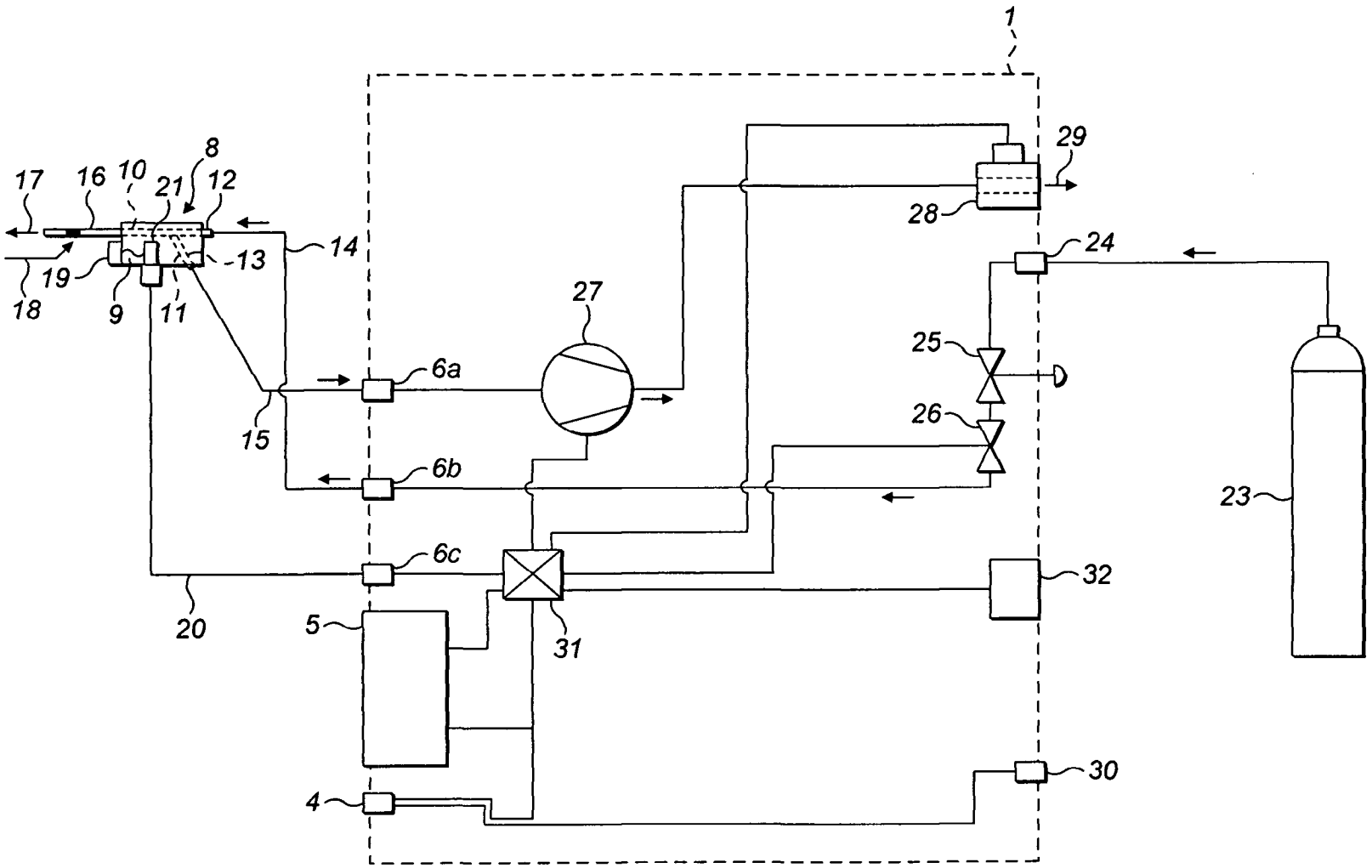
FIG. 3 is a schematic illustration of the components, including the control unit of FIG. 1, of gas filling apparatus in accordance with the present invention.

Referring now to FIG. 3, here the control unit 1 is shown connected to a lance 8. The lance 8 comprises a body 9 of clear acetate having passages 10 and 11 drilled through it, passage 11 intersecting passage 10. Each passage has a threaded portion on one end thereof for receiving a respective connector 12 or 13. Connector 12 is in turn connected to a gas supply line 14, for receiving gas from the control unit 1 and connector 13 is connected to a vacuum return line 15, connected to the control unit 1.

A coaxial pipe 16 extends through passage 10 of lance 8, to protrude beyond the block 9 to form the nozzle of the lance 8. The inner pipe of the coaxial pipe 16 is connected to the gas supply line 14, such that gas from the gas supply line 14 is dispensed in the direction of arrow 17.

The outer pipe of the coaxial pipe 16 is connected to vacuum return line 15, such that when the coaxial pipe 16 is inserted through an aperture in an insulated glass unit, air/gas mixture can be drawn in the direction of arrow 18, through the lance to the vacuum return line 15, as gas is simultaneously dispensed into the glass unit (not shown). The lance 8 further comprises a switch 19, connected by cable 20 to the electrical connection 6*c* of the control unit 1 and a two colour LED 21 mounted in a machined recess in the body 9 of the lance 8. The LED is visible through the clear body 9 of the lance 8. The LED may be either OFF, green or red.

In operation, the control unit 1 receives gas from a gas supply bottle 23 connected to the gas inlet 24. From here the gas passes through pressure regulator 25, solenoid valve 26 to the gas supply port 6*a* for the lance 8.

Returned air and/or gas from the lance 8 is received via vacuum port 6*b* of the control unit 1, the air and/or gas being forced by vacuum pump 27 through gas sensor 28 to exhaust 29.

The control unit 1 receives it power from a mains supply connection 30 and mains switch 4. This energises the touch screen display 5 and control electronics 31. The control electronics 31 controls the display on the touch screen display 5 and detects operator inputs on the display 5. The control electronics 31 receives inputs from the switch 19 on the lance 8, via electrical connector 6*c* and also receives a signal from the gas sensor 28. The control electronics also control the vacuum pump 27 and a sounder 32.

In operation, the operator first switches on the mains switch 4 and, if necessary, goes to the menu on the touch screen display and goes to the settings page, illustrated in FIG. 2. Here, he can adjusts the target fill, overfill timer, sounder timer and dwell time as appropriate. This may depend on the size of the glass unit which it be filled. The settings may be set for each lance connected to the control unit.

The gas filling apparatus will then be operated in the manner described below with reference to FIG. 3. This describes operation with reference to a single lance 8 only. However, a control unit will have an identical set of components to those illustrated in FIG. 3 for each lance which can operate from the control unit, and the operation of each set will be the same.

Having switched the control unit 1 on and selected the desired settings, the operator then picks up the lance 8 and inserts it into a drilled aperture in the space bar of an insulated glass unit (not shown) to be filled with gas, which will typically be argon gas. As the operator inserts the lance 8 in the aperture, he presses the switch 19 which sends a signal along cable 20 to the control electronics 31. In response to the signal, the control electronics activates the LED 21, so that it lights up red (indicating to an operator that gas is being dispensed) and opens solenoid valve 26, causing gas to be flow from coaxial pipe 16 in direction of arrow 17.

The control electronics 31 simultaneously activates vacuum pump 27, which draws air/gas mixture from the insulated glass unit through vacuum return line 15. The air/gas mixture passes through gas detector 28 from where it exits from exhaust 29. The control electronics monitors the output of the gas detector 28 and compares this with the preset target fill, in the case illustrated in FIG. 2 the target fill rate is 92%.

As the argon gas sinks to the bottom of the unit to be filled, air is expelled from the top and when the unit is nearly completely full of argon gas, the concentration of argon gas detected by gas detector 28 will rise until it reaches 92%.

When the control electronics 31 determines that the target fill (92%) has been reached, it continues to maintain solenoid valve 26 in an open state for a predetermined period of time, corresponding to that set on the overfill timer (one second). At the end of this additional period, the control electronics 31 closes solenoid valve 26, stops the vacuum pump 27, switches the LED 21 to green (indicating to the operator that the lance can be removed and the aperture plugged) and operates the sounder 32 for the sounder timer period set (one second). The operator hears the sounder and if he should be operating more than one lance, identifies the lance 8 which has a green LED, indicating that the lance may be removed from the unit and the aperture in the space bar plugged.

Once the dispensing of gas has been terminated, the control electronics determines the dwell time set by the operator (thirty seconds), and after dispensing has been terminated for thirty seconds switches the LED OFF. If the operator has not been able to remove the lance and plug the aperture in the insulated glass unit, in which the lance 8 is inserted, the absence of the green LED indicates that the unit has exceeded its dwell time since filling. The operator should then actuate the switch 19 again and the above procedure is repeated. However this time the unit will already be substantially full of argon gas and it will normally only be a couple of second before the 92% target fill is reached, the dispensing terminated and the LED returned to green.

Regardless of whether the LED is OFF or in the green state, operating the switch 19 will recommence the dispensing of gas so that the operator can immediately commence filling of the next unit. However, operation of the switch 19, while the LED is red (gas being dispensed), will manually stop the dispensing of gas and the LED will return to its OFF state.

Gas filling apparatus in accordance with the present invention enables an operator to simultaneously operate a number of lances. If this should exceed the operators capacity at any point, this will simply result in one or more lances exceeding the dwell time for that lance, whereupon the situation can be swiftly rectified by recommencing dispensing of gas from the lance by operation of the switch 19, ensuring that all insulated glass units are correctly filled.

The above invention has been described by way of example only and other arrangements are envisaged within the scope of the appended claims. Also, the invention has been described with reference to apparatus for filling insulated glass units, however it is the gas filling apparatus may have other applications.

What is claimed is:

1. A gas filling apparatus, comprising:

a lance having a dispensing nozzle for dispensing gas through an aperture;

a control unit remote from the lance; and a gas supply line extending from the control unit to the lance, wherein the lance comprises a manually operable switch for sending a signal to the control unit and the control unit is arranged to dispense gas through the lance in response to a signal received from the manually operable switch, wherein the control unit further comprises a vacuum port and a gas sensor for determining the concentration of the dispensed gas type received at the vacuum port, the unit being arranged to terminate the dispensing of gas in response to the gas received at the vacuum port exceeding a predetermined concentration.

2. The apparatus of claim 1, wherein the lance is arranged to be handheld, the lance is connected to the control unit through a flexible gas supply line, and the lance is arranged to be inserted in the aperture in a non-engaging manner.

3. The apparatus of claim 1, wherein the control unit incorporates an overfill timer which terminates the dispensing of gas a predetermined period after the gas received at the vacuum port exceeds the predetermined concentration.

4. The apparatus of claim 1, wherein the control unit further comprises a dwell timer which provides an indication to an operator when a predetermined dwell time, after termination of dispensing, has been exceeded.

5. The apparatus of claim 1, wherein the lance incorporates a visual indicator to indicate a status of the control unit.

6. The apparatus of claim 5, wherein the visual indicator indicates when gas is being dispensed.

7. The apparatus of claim 5, wherein the visual indicator indicates when dispensing has been terminated but a predetermined dwell time after termination of dispensing has not been exceeded.

8. The apparatus of claim 5, wherein the visual indicator comprises a light.

9. The apparatus of claim 8, wherein the light is a light source which can be one of at least two colours or off and is arranged to indicate at least three states of the control unit; gas being dispensed; dispensing complete but a predetermined dwell time has not been exceeded; and dwell time exceeded or dispensing not commenced.

10. The apparatus of claim 1, wherein the lance comprises a solid block of plastics material having machined passageways and threaded connection ports with a visual indicator embedded in the solid block, and the solid block being transparent or translucent.

11. The apparatus of claim 1, wherein the dispensing nozzle comprises a vacuum inlet aperture connected to the vacuum port of the control unit via a vacuum return line.

12. The apparatus of claim 11, wherein the vacuum inlet aperture is arranged coaxially with the dispensing nozzle.

13. The apparatus of claim 1, further comprising an electrical or optical connection lead between the manually operable switch and the control unit.

14. A gas filling lance, comprising:

a solid body of translucent or transparent material having passages drilled through it which each have a threaded portion at one end thereof for receiving a respective connector;

a dispensing nozzle;

a first connector for connection of a gas supply line to the nozzle;

a second connector to connect to a line for receiving gas received by said nozzle;

a switch mounted in the solid body of translucent material for generating an electrical signal; and an indicator light embedded in the solid body.

* * * * *